United States Patent [19]

Sanelli

[11] Patent Number: 4,712,304

[45] Date of Patent: Dec. 15, 1987

[54] KNIFE HAVING A HANDLE COATED WITH AN ELASTOMER, PARTICULARLY FOR PROFESSIONAL USES

[76] Inventor: Danilo Sanelli, Via Roma, 1, Premana, Como, Italy

[21] Appl. No.: 761,229

[22] Filed: Jul. 31, 1985

[30] Foreign Application Priority Data

Sep. 26, 1984 [IT] Italy ..... 23329/84[U]

[51] Int. Cl.[4] ..... B25G 3/00

[52] U.S. Cl. ..... 30/343; 16/DIG. 18; 16/DIG. 19

[58] Field of Search ..... 30/340, 342–344; 16/116 R, DIG. 18, DIG. 19; D7/137, 130, 151

[56] References Cited

U.S. PATENT DOCUMENTS

| | | | |
|---|---|---|---|
| 2,520,355 | 8/1950 | Bell | 30/340 |
| 2,782,454 | 2/1957 | Baer | 16/116 R |
| 3,189,069 | 6/1965 | Sowell | 16/116 R X |
| 4,016,315 | 4/1977 | Szabo | 16/116 R X |
| 4,178,684 | 12/1979 | Mightly | 30/345 X |

*Primary Examiner*—Douglas D. Watts

*Attorney, Agent, or Firm*—Young & Thompson

[57] ABSTRACT

A knife for professional applications comprising a cutting blade, a body of synthetic plastic material in which the shank of the cutting blade is buried, and a layer of an elastomer at least partially covering the body of synthetic plastic material.

9 Claims, 3 Drawing Figures

KNIFE HAVING A HANDLE COATED WITH AN ELASTOMER, PARTICULARLY FOR PROFESSIONAL USES

This invention relates to a knife having a handle coated with an elastomer.

The knife of the invention is particularly designed for professional uses and, thus, for uses of a continuous or intermittent nature.

Due to the intended use of the knife according to the invention, the elastomer to be utilized for coating the knife handle should be one that is capable of conveniently absorbing the shocks to which it may be subjected, of offering a good slippage resistance even when in contact with greasy substances, of not being attacked by common detergents, and of temperature resistance to at least 120° C. Thus, a synthetic rubber of the butadiene-styrene (Buna), or the ethylene-propylene, or the polyacrylic ester based type, or also a thermoplastic elastomer such as of the polyester-polyether based type, may be advantageously used as said elastomer.

The above elastomers are capable of being thoroughly sealed to the plastic material (preferably of the shock-resistant type, i.e., of the class of the polyamide resins) in which the shank of the knife blade is buried.

For a better understanding of the invention, a preferred embodiment of a knife with elastomer-covered handle according to the invention will be described hereinbelow in more detail, reference being made to the accompanying drawing, in which.

Figures 1, 2, 3:
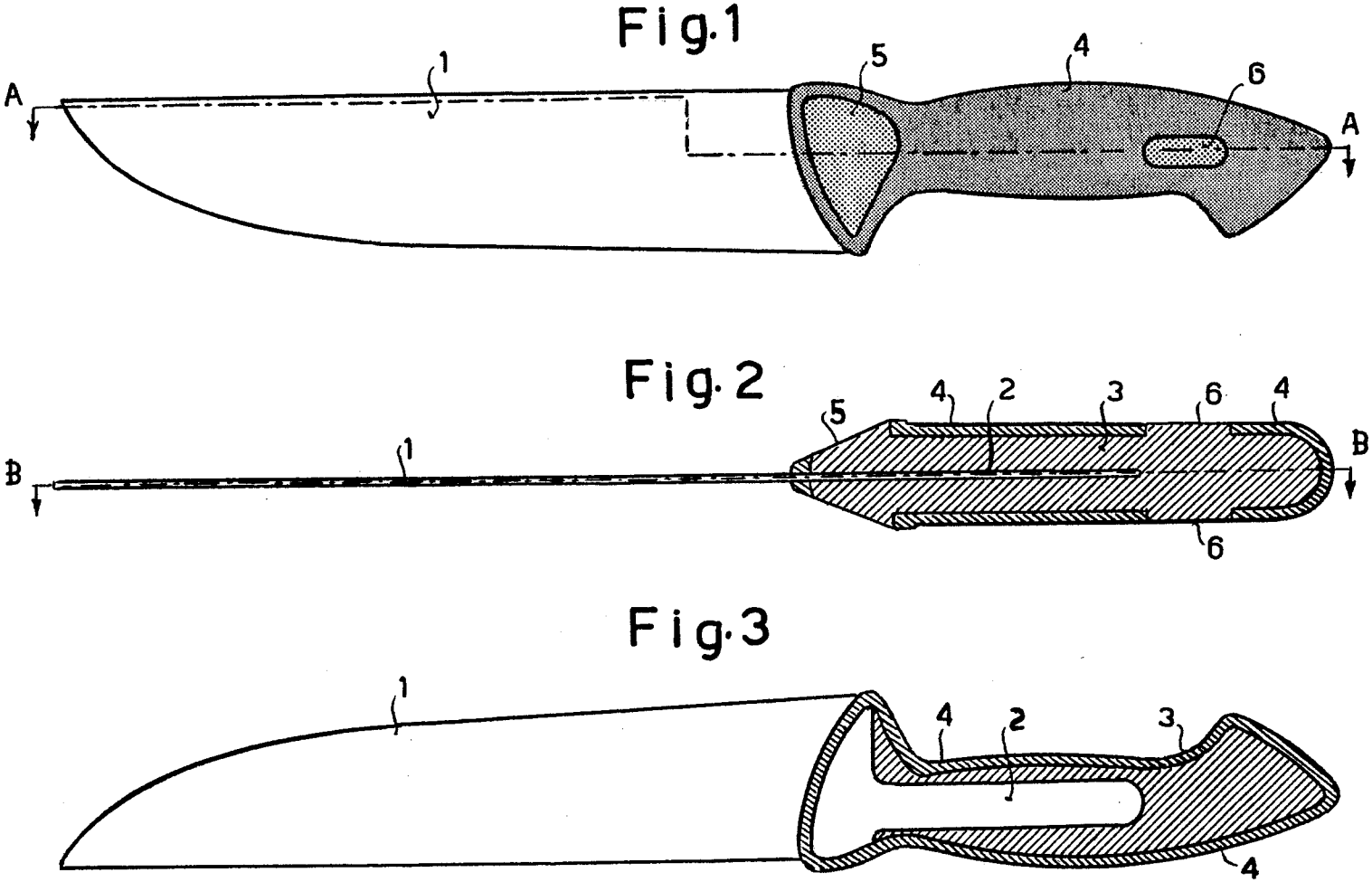
FIG. 1 is a side view of a knife according to the invention.
FIG. 2 is a section view of the same knife taken along the line A—A of FIG. 1.
FIG. 3 is a section view of the same knife taken along the line B—B of FIG. 2.

The knife according to the invention, a preferred embodiment of which is shown by the accompanying drawing, is essentially comprised of a cutting blade 1 (made, for example, of hardened or stainless steel), the shank of said knife being buried in, and supported by a body 3 made of a synthetic plastic material which is, in turn, covered by a layer of elastomer 4.

As can be seen from the figures of the drawing, said elastomer does not cover the handle in the form of a body 3 of synthetic plastic material in a complete manner and, in fact, it leaves at least a front zone, such as the zone 5, and an intermediate zone, such as the zone 6, partially uncovered thereon (FIGS. 1 and 3), which zones 5 and 6 are, however, integral with the body 3 and maintained at the same level as that of the outer surface of coating 4.

The above arrangement serves, among other things, better to anchor said resilient coating to the body of rigid synthetic plastic material supporting the shank 2 of blade 1, while preserving a smooth, flush handle surface for comfort, and for ease of use and maintenance.

It should be apparent that the shape and size of both the cutting blade and the handle of the knife are not features of novelty of the invention.

What is claimed is:

1. A knife for professional application comprising a cutting blade (1) having a shank (2), a handle in the form of a body (3) of synthetic plastic material in which said shank is buried, and a layer of an elastomer (4) covering said body, said elastomeric layer being partially discontinuous over at least one front zone (5) and at least one intermediate zone (6) comprised by the body (3) of plastic material to which the shank (2) of the cutting blade (1) is attached such that the body (3) is left exposed at the discontinuous zones (5) and (6), said zones being spaced apart from each other, the level of the body at said discontinuous zone and the level of the body covered by said elastomer layer being equal such that said exposed zones are flush with said elastomer layer.

2. A knife according to claim 1, wherein said front zone (5) is superposed on said blade (1) and said shank (2).

3. A knife according to claim 1, wherein said intermediate zone (6) is disposed toward the end of the handle opposite the blade (1).

4. A knife according to claim 1, wherein said body (3) is a polyamide resin.

5. A knife according to claim 1, wherein said elastomeric layer (4) is a synthetic rubber of the butadiene-styrene type.

6. A knife according to claim 1, wherein said elastomeric layer (4) is a synthetic rubber of the ethylene-propylene type.

7. A knife according to claim 1, wherein said elastomeric layer (4) is a synthetic rubber of the polyacrylic ester type.

8. A knife according to claim 1, wherein said elastomeric layer (4) is a thermoplastic elastomer of the polyester-polyether type.

9. A knife according to claim 1, in which the exposed body at the discontinuous zones is outstanding from the remainder of said body by a distance equal to the thickness of said elastomeric layer that covers said remainder of the body.

* * * * *